US011313090B2

(12) United States Patent
Piotrowski et al.

(10) Patent No.: US 11,313,090 B2
(45) Date of Patent: Apr. 26, 2022

(54) AUXILIARY SNOW MOVING MEMBERS AND SNOW REMOVAL MACHINES HAVING AT LEAST ONE AUXILIARY SNOW MOVING MEMBER

(71) Applicant: Canadian Tire Corporation, Limited, Toronto (CA)

(72) Inventors: Tomasz Piotrowski, Toronto (CA); Michael Fuina, King City (CA); Sean Zylstra, Kitchener (CA); Timothy James Sommerfeld, Ariss (CA); Michael Daniel Vermeer, Kitchener (CA); Michael Mackuliak, Waterloo (CA); Shaun Zimmerman, Kitchener (CA); Victor Lai, Markham (CA)

(73) Assignee: Canadian Tire Corporation, Limited, Toronto (CA)

( * ) Notice: Subject to any disclaimer, the term of this patent is extended or adjusted under 35 U.S.C. 154(b) by 291 days.

(21) Appl. No.: 16/682,360

(22) Filed: Nov. 13, 2019

(65) Prior Publication Data

US 2020/0157755 A1 May 21, 2020

Related U.S. Application Data

(60) Provisional application No. 62/767,855, filed on Nov. 15, 2018.

(51) Int. Cl.

| | |
|---|---|
| ***E01H 5/09*** | (2006.01) |
| ***A46B 13/00*** | (2006.01) |
| ***E01H 5/04*** | (2006.01) |

(52) U.S. Cl.

CPC ..... *E01H 5/092* (2013.01); *A46B 13/001* (2013.01); *E01H 5/045* (2013.01); *E01H 5/098* (2013.01); *A46B 2200/3066* (2013.01)

(58) Field of Classification Search

CPC .. E01H 5/12; E01H 5/09; E01H 5/098; E01H 5/092; A46B 13/001; A46B 2200/3066

See application file for complete search history.

(56) References Cited

U.S. PATENT DOCUMENTS 1,638,708 A * 8/1927 Saxon ..... E01H 5/098 37/252

1,764,084 A * 6/1930 Nelson ..... E01H 5/098 37/190

(Continued)

OTHER PUBLICATIONS

Lowe's Canada, *The HEFT Ergonomic Secondary Handle*, (2 pages), [online], [online], [Retrieved from the Internet May 4, 2020], <https://www.lowes.ca/product/snow-shovels/the-heft-ergonomic-secondary-handle-752810?&cm_mme=google-_-1698293514-_-86410042267-_-aud-377300556203:dsa-836885221333&gclid=Cj0KCQjwka_1BRCPARRIsAMUmEqWhjnJXD4UqwK01pmRvvPt-bdsTYLBbfMRFIt4errub-yUEl0ALFoaAilTEALw_weB&gelsrc=aw.ds>.

*Primary Examiner* — Jamie L McGowan

(74) *Attorney, Agent, or Firm* — Alston & Bird LLP

(57) ABSTRACT

Snow removal machines are provided that have an auger assembly for directing snow rearwards to be received by a discharge chute, and an auxiliary snow moving assembly for directing snow rearwards to be received by the discharge chute. The auger assembly has auger blade(s) coupled to an auger axle for rotation therewith about a first axis defined by the auger axle. The auxiliary snow moving assembly has snow moving member(s) coupled to an auxiliary axle for rotation therewith about a second axis defined by the auxiliary axle. The auxiliary axle is lower and rearwards of the auger axle towards the discharge chute; and an auxiliary drive assembly is configured to rotationally couple the (Continued)

auxiliary axle to the auger axle such that rotation of the auxiliary axle is driven by rotation of the auger axle.

18 Claims, 14 Drawing Sheets

(56) References Cited

U.S. PATENT DOCUMENTS 1,820,707 A * 8/1931 Moen ..... E01H 5/098 37/250
2,169,224 A * 8/1939 Cole ..... E01H 5/098 37/250
2,197,549 A * 4/1940 Hargrave ..... E01H 5/12 299/25
2,320,723 A * 6/1943 Levi ..... E01H 5/09 37/250
2,381,017 A * 8/1945 Wandscheer ..... E01H 5/09 37/248
2,508,829 A * 5/1950 Lamy ..... E01H 5/045 37/227
2,777,217 A * 1/1957 Klauer ..... E01H 5/098 37/250
3,340,626 A * 9/1967 Konucik ..... E01H 5/092 37/243
3,591,236 A * 7/1971 Jones ..... E01H 4/023 299/24
3,695,716 A * 10/1972 Meyer ..... E01H 5/12 299/25
3,721,025 A * 3/1973 Orr ..... E01H 5/098 37/227
3,726,029 A * 4/1973 Deen ..... E01H 5/045 37/261
3,805,421 A * 4/1974 Kamlukin ..... E01H 5/045 37/233
4,307,524 A * 12/1981 Anderson ..... E01H 5/12 172/784
4,833,800 A * 5/1989 Ting ..... A01D 42/08 37/243
4,869,003 A * 9/1989 O'Loughlin ..... E01H 5/098 37/255
4,951,403 A * 8/1990 Olmr ..... E01H 5/04 37/244
5,106,165 A * 4/1992 Lattman ..... B28D 1/181 172/554
5,540,004 A * 7/1996 Patterson ..... A46B 13/001 15/55
5,813,152 A * 9/1998 Weight ..... E01H 5/08 37/249
5,893,224 A * 4/1999 Harrington ..... E01H 5/098 37/257
6,199,306 B1 * 3/2001 Kauppila ..... E01H 5/04 37/249
7,121,021 B2 * 10/2006 Sakai ..... E01H 5/045 37/251
9,663,909 B2 * 5/2017 Mast ..... E01H 5/094
9,752,294 B2 * 9/2017 Schmalz ..... E01H 5/098
2015/0252544 A1 * 9/2015 Houle ..... E01H 5/098 37/258
2015/0315758 A1 * 11/2015 Spievey ..... E01H 5/102 37/229
2020/0157755 A1 * 5/2020 Piotrowski ..... A46B 13/001
2020/0318303 A1 * 10/2020 Jewett ..... A46B 7/044
2021/0301486 A1 * 9/2021 Favorito ..... E01H 5/076

* cited by examiner

AUXILIARY SNOW MOVING MEMBERS AND SNOW REMOVAL MACHINES HAVING AT LEAST ONE AUXILIARY SNOW MOVING MEMBER

CROSS-REFERENCE TO RELATED APPLICATIONS

This application claims the benefit of U.S. Provisional Patent Application No. 62/767,855, filed on Nov. 15, 2018, which is incorporated by reference herein in its entirety.

FIELD

The specification relates generally to snow removal machines, and specifically to auxiliary snow moving members for snow moving machines and snow machines having such auxiliary snow moving members.

BACKGROUND

When operating typical snow removal machines, the auger usually leaves behind a trail of snow. Some known snow removal machines, such as snow removal machine 100 shown in FIG. 1, include a scraping device 102 mounted to a lower portion of the auger housing 104 to help collect the snow left behind by the auger. However, these scraping devices tend to also leave at least some snow behind. As a result, users may have to resort to shovelling in addition to using a snow machine to satisfactorily clean a surface of snow.

SUMMARY

According to some embodiments there is provided a snow removal machine comprising: an auger assembly for directing snow rearwards to be received by a discharge chute, the auger assembly having at least one auger blade coupled to an auger axle for rotation therewith about a first axis defined by the auger axle; an auxiliary snow moving assembly for directing snow rearwards to be received by the discharge chute, the auxiliary snow moving assembly having at least one snow moving member coupled to an auxiliary axle for rotation therewith about a second axis defined by the auxiliary axle, wherein the auxiliary axle is lower and rearwards of the auger axle towards the discharge chute; and an auxiliary drive assembly configured to rotationally couple the auxiliary axle to the auger axle such that rotation of the auxiliary axle is driven by rotation of the auger axle.

According to some embodiments, the snow removal machine is a snow thrower or a snow blower.

According to some embodiments, the auxiliary drive assembly is configured to drive rotation of the auxiliary axle in a rotational direction opposite that of the auger axle.

According to some embodiments, the at least one snow moving member comprises a brush having bristles coupled to the auxiliary axle. According to some embodiments, the bristles are mounted about the auxiliary axle in a spiral pattern. According to some embodiments, the bristles comprise plastic bristles each having a steel core. According to some embodiments, the bristles have a length of about 0.5 inches to about 1.5 inches.

According to some embodiments, the auxiliary drive assembly is further configured to disengage rotation of the auxiliary axle from that of the auger axle. According to some embodiments, the auxiliary drive assembly comprises a clutch mechanism.

According to some embodiments, the auxiliary drive assembly comprises: an auger pulley coupled to the auger axle for rotation therewith about the first axis; an auxiliary pulley coupled to the at least one auxiliary axle for rotation therewith about the second axis; and an endless drive member coupled to the auger pulley and the auxiliary pulley for transferring torque from the auger axle to the auxiliary axle.

According to some embodiments, the snow removal machine further comprises a snow scraping blade positioned between the auger axle and the auxiliary axle.

According to some embodiments there is provided an auxiliary snow moving assembly for a snow removal machine comprising: an auxiliary axle defining a rotational axis; a snow moving member for directing snow rearwards to be received by a discharge chute of the snow removal machine, the snow removing member being coupled to the auxiliary axle for rotation therewith about the rotational axis; an attachment assembly for coupling the auxiliary axle to the snow removal machine and for positioning the auxiliary axle rearwards and lower than an auger axle having at least one auger blade mounted for rotation therewith; and an auxiliary drive assembly for coupling the auxiliary axle to the auger axle such that rotation of the auxiliary axle is driven by rotation of the auger axle.

According to some embodiments, the auxiliary drive assembly is further configured to disengage rotation of the auxiliary axle from that of the auger axle. According to some embodiments, the auxiliary drive assembly comprises a clutch mechanism.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
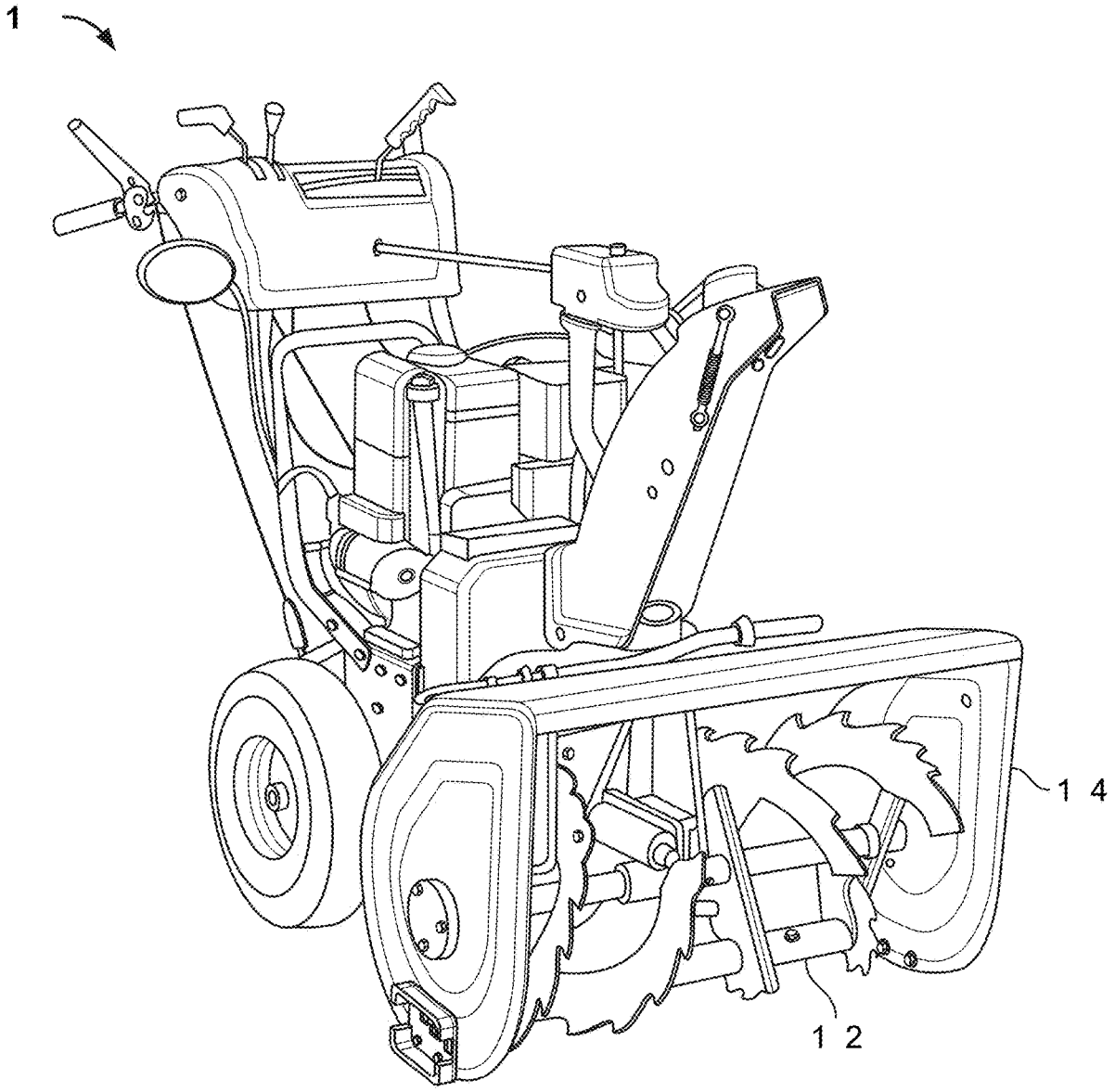
PRIOR ART FIG. 1
FIG. 1 depicts a prior art snow removal machine.

Herein described are snow removal machines, such as snow throwers or snow blowers, having at least one auxiliary snow moving member. As described further below, the at least one auxiliary snow moving member is part of an auxiliary snow moving assembly configured to direct snow rearwards for receipt by a discharge chute of the snow removal machine. The snow removal machines are either snow blowers or snow throwers. According to some embodiments, the described snow removal machines may be single-stage, two-stage or three-stage snow removal machines. For example, according to some embodiments, the snow removal machines comprise an impeller assembly operatively coupled to the auger assembly.

It will be appreciated that for simplicity and clarity of illustration, where considered appropriate, reference numerals may be repeated among the figures to indicate corresponding or analogous elements. In addition, numerous specific details are set forth in order to provide a thorough understanding of the exemplary aspects of the present application described herein. However, it will be understood by those of ordinary skill in the art that the exemplary aspects described herein may be practiced without these specific details. In other instances, well-known methods, procedures and components have not been described in detail so as not to obscure the exemplary aspects described herein. Also, the description is not to be considered as limiting the scope of the exemplary aspects described herein. Any systems, method steps, method blocks, components, parts of components, and the like described herein in the singular are to be interpreted as also including a description of such systems, method steps or tasks, components, parts of components, and the like in the plural, and vice versa.

Figure 2:
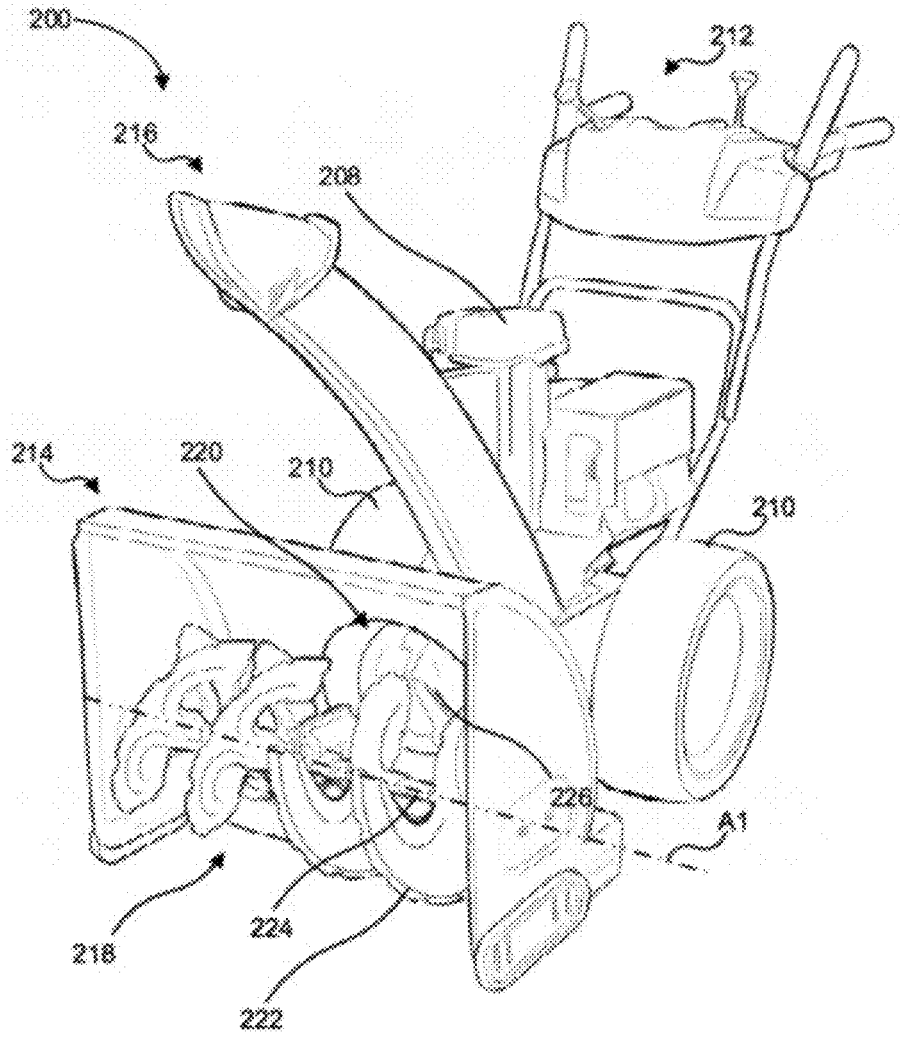
FIG. 2 depicts a front perspective view of an example snow removal machine, according to a non-limiting embodiment.

Attention is directed to FIG. 2 which depicts an example snow machine 200. Snow machine 200 includes an engine or motor (shrouded by housing 208) operatively coupled to wheels 210 by a transmission assembly (not shown), as known in the art. Snow machine 200 also includes a steering assembly 212.

Auger housing system 214 is operatively coupled to discharge chute 216 through which snow collected by an auger assembly 218 is ejected from the snow machine 200. Auger assembly 218 is coupled to the auger housing system 214 and is configured to direct snow rearwards for receipt by the discharge chute 216 via, for example, a discharge chute inlet 220 of the auger housing system 214.

Figure 5:
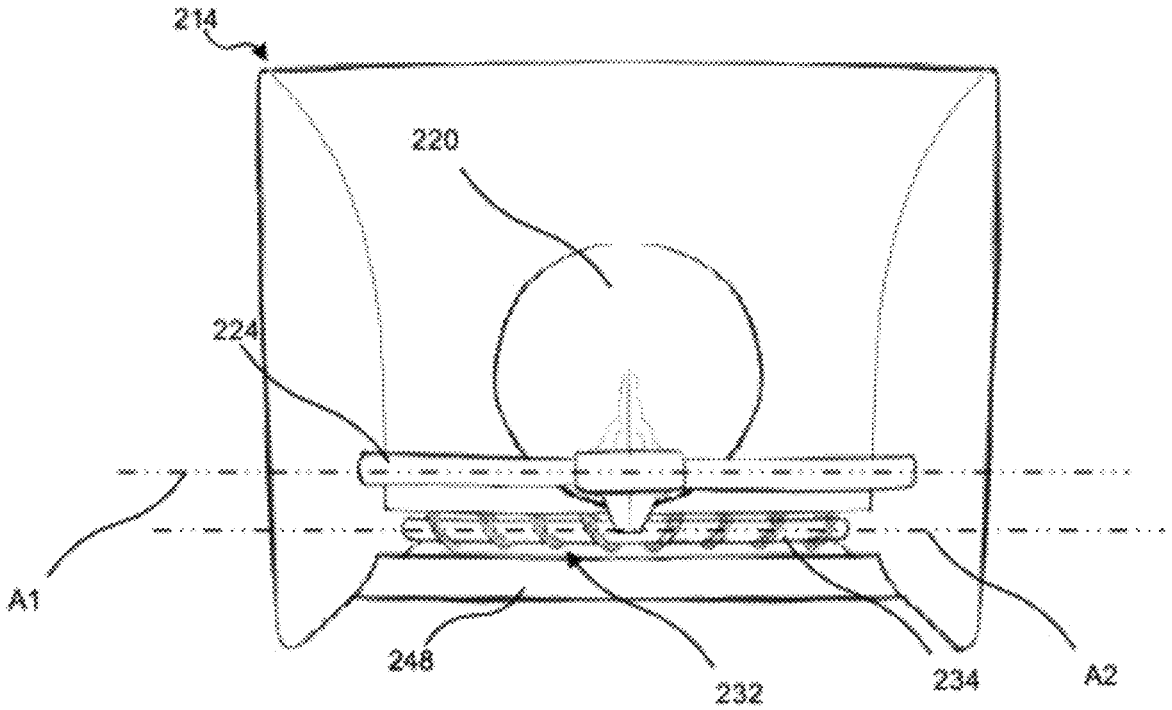
FIG. 5 depicts a front view of the auger housing and aspects of the auger assembly and snow removing assembly of FIGS. 2 and 3, according to a non-limiting embodiment.

Auger assembly 218 comprises an arrangement of one or more auger blade(s) 222 to break apart snow and/or ice and to direct such snow and/or ice towards the discharge chute 216. Auger blade(s) 222 are coupled to auger axle 224 to rotate with the auger axle 224 about a first axis of rotation A1 (defined by auger axle 224, as shown in FIG. 5). Auger assembly 218 is operatively coupled to the engine or motor by an auger transmission (not shown), as is known in the art, such that rotation of auger axle 224 is driven by the engine or motor.

Any suitable shape or arrangement of the auger blade(s) 222 is contemplated. For example, according to some embodiments, auger blade(s) 222 comprises one or more helical blades or series of helical blades rotatable about axis A1. According to some embodiments, the auger blade(s) 222 comprises one or more helical flights coupled to the auger axle 224 to form a composite auger blade. According to some embodiments, the auger blade(s) 222 may comprise a single blade. According to some embodiments, the auger blade(s) 222 comprise one or more corkscrew blades or series of corkscrew blades rotatable about axis A1. According to some embodiments, the auger blade(s) 222 comprise auger blades of more than one shape.

Example snow removal machine 200 also includes an impeller 226 operatively coupled to auger assembly 218 proximate the discharge chute inlet 220. At least some of the snow and/or ice directed by the auger assembly 218 (via auger blade(s) 222) rearwards towards the discharge chute 216 is received by the impeller 226. The impeller 226 further breaks down the received snow and/or ice and further drives the snow and/or ice through the discharge chute 216 for ejection from the snow removal machine 200. Although example snow removal machine 200 includes impeller 226, it is understood that in some embodiments the described snow removal machines may not include an impeller.

Figure 3:
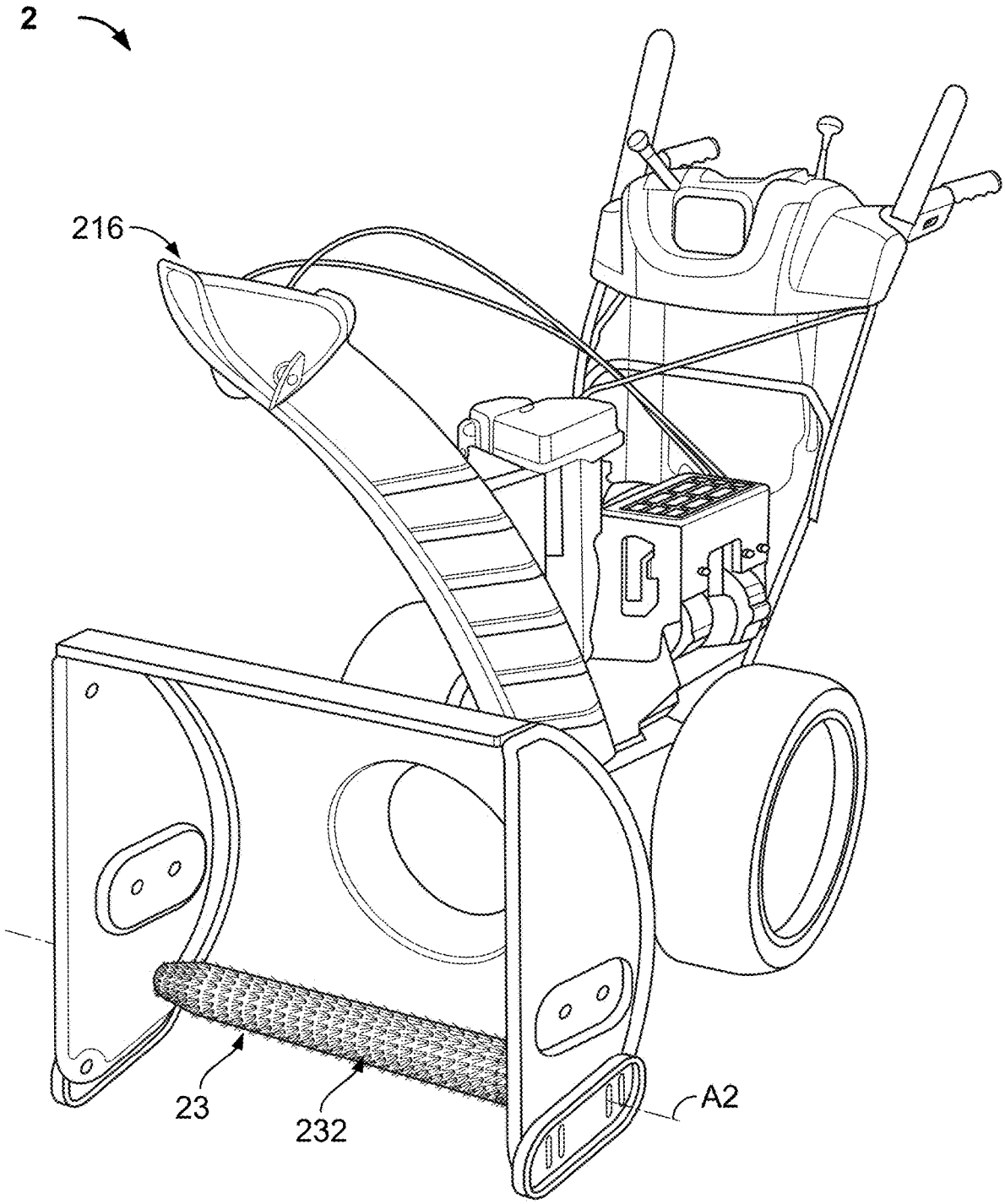
FIGS. 3 and 4 depict a front perspective view of the example snow removal machine of FIG. 2, without the auger assembly to better show an auxiliary snow moving assembly, according to a non-limiting embodiment.
Figure 4:
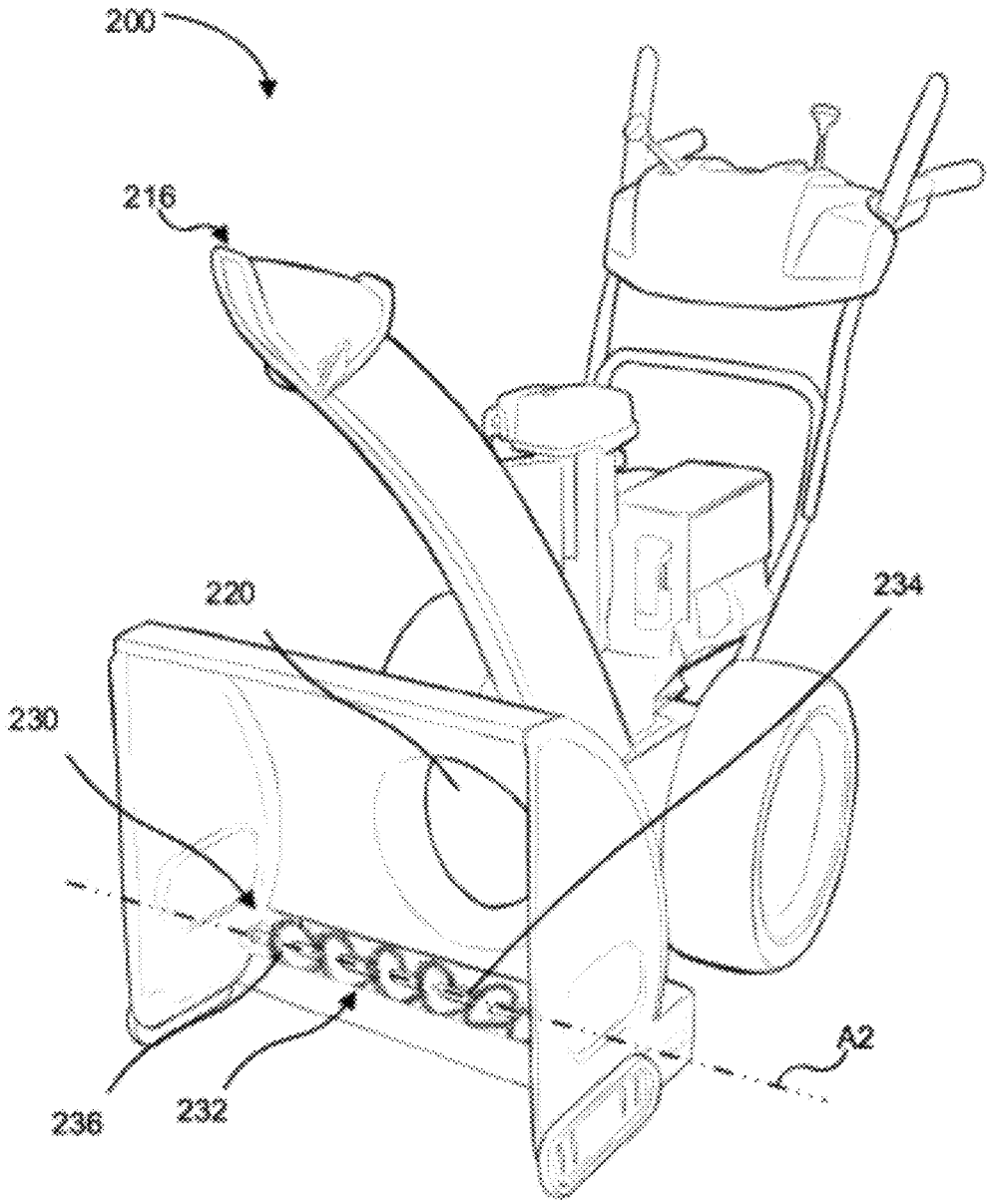
Figure 6:
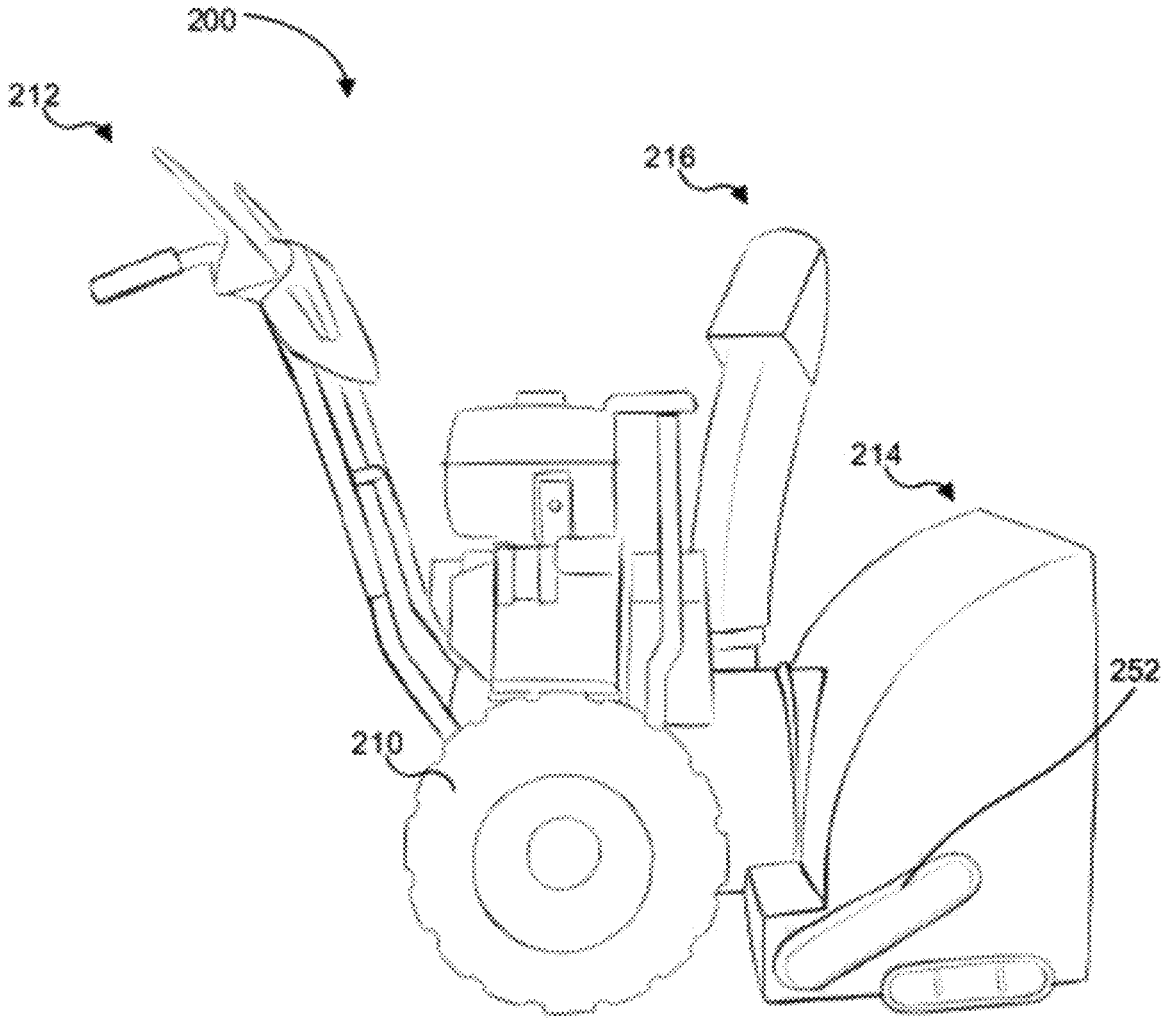
FIG. 6 depicts a side view of the example snow removal machine of FIG. 2, according to a non-limiting embodiment.

Attention is directed to FIGS. 3 and 4, which depicts snow removal machine 200 absent auger assembly 218 for clarity. As shown in FIGS. 3 and 4, snow removal machine 200 also includes an auxiliary snow moving assembly 230 for directing snow rearwards for receipt by the discharge chute 216 (for example, via the discharge chute inlet 220). Auxiliary snow moving assembly 230 includes at least one snow moving member 232 coupled to an auxiliary axle 234 for rotation therewith about a second axis of rotation A2 defined by the auxiliary axle 234. Auxiliary snow moving assembly 230 is positioned in relation to auger assembly 218 such that at least some of the snow left behind by auger assembly 218 may be directed rearwards towards to the discharge chute 216 (which may be via the impeller 226). According to some embodiments, auxiliary axle 234 is lower and rearward of auger axle 224 (see, for example, FIGS. 5 and 7). Auxiliary snow moving assembly 230 may be coupled to the snow removal machine 200 by any suitable attachment assembly. According to some embodiments, the auxiliary snow moving assembly 230 comprises an attachment assembly configured to couple the auxiliary axle 234 to the snow removal machine 200, such as via auger housing system 214. The attachment assembly is also configured to position the auxiliary axle 234 rearwards and lower than an auger axle having at least one auger blade mounted for rotation therewith (such as auger axle 224). For example, as shown in FIG. 6, the snow moving assembly 230 may comprise at least one supporting bracket 252 configured to support and orient the auxiliary axle 234 in respect of the auger axle 234. According to some embodiments, the at least one supporting bracket 252 is built into auger housing system 214 or otherwise coupled to the auger housing system 214.

Snow moving member(s) 232 can take many forms. According to some embodiments, snow moving member(s) 232 comprises a brush 236 having bristles coupled to auxiliary axle 234. The bristles comprise any suitable configuration for directing snow from a terrain or surface trailing the auger blade 224 for receipt by the discharge chute 216. For example, according to some embodiments, the bristles are mounted to auxiliary axle 234 in a spiral pattern about at least a portion of the auxiliary axle 234 configured to funnel snow towards the discharge chute 216 (e.g., via discharge chute inlet 220). According to some embodiments, the bristles comprise plastic bristles each having a steel core. According to some embodiments, bristles 236 have a length of about 0.5 inches to about 1.5 inches. According to some embodiments, the diameter of each one of bristles 236 is about 1 mm. According to some embodiments, bristles 236 comprises clusters of a plurality of bristles. According to some embodiments, the clusters are spaced apart along at least a portion of the length of auxiliary axle 234. According to some embodiments, the diameter of at least one of clusters of bristles is about 0.25 inches.

Figure 11:
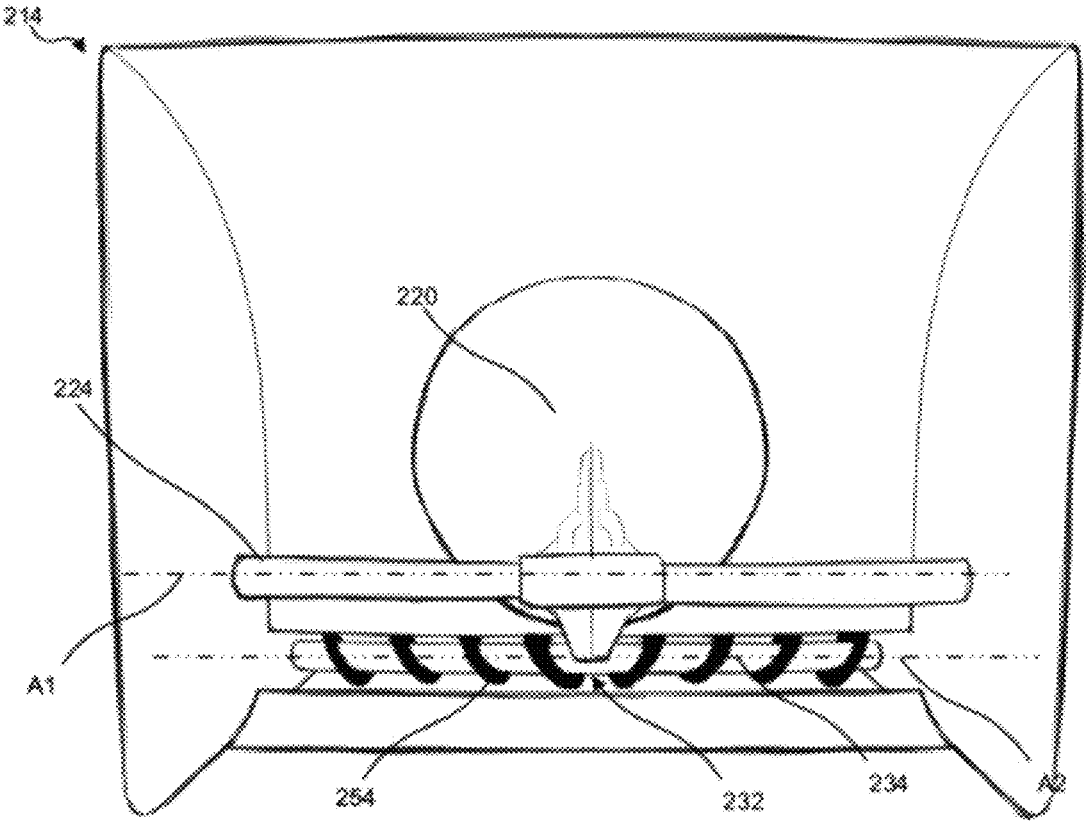
FIG. 11 depicts a front view of the auger housing and aspects of the auger assembly and snow removing assembly of FIGS. 2 and 3, according to another non-limiting embodiment.

Other forms of snow moving member(s) 232 are also contemplated. For example, according to some embodiments, snow moving member(s) 232 comprise at least one resilient flexible member coupled to the auxiliary axle 224. The resilient flexible members engage snow trailing auger blade 222 to lift and direct it towards the discharge chute 216 for ejection from the snow machine 200. According to some embodiments, the at least one of the resilient flexible members comprises a solid helical rubber "paddle", an example of which is shown in FIG. 11 (as paddle 254). Paddle 254 is manufactured from any suitable material or combination of materials.

Auxiliary snow moving assembly 230 and auger assembly 218 are operatively coupled to each other. Specifically, an auxiliary drive assembly (such as auxiliary drive assemblies 238 and 338 depicted in FIGS. 7, 8 and 10) is configured to rotationally couple auxiliary axle 234 to auger axle 224 such that rotation of auxiliary axle 234 is driven by rotation of auger axle 224. As a result, an additional motor to drive the auxiliary snow moving member(s) 232 is not required.

Figure 7:
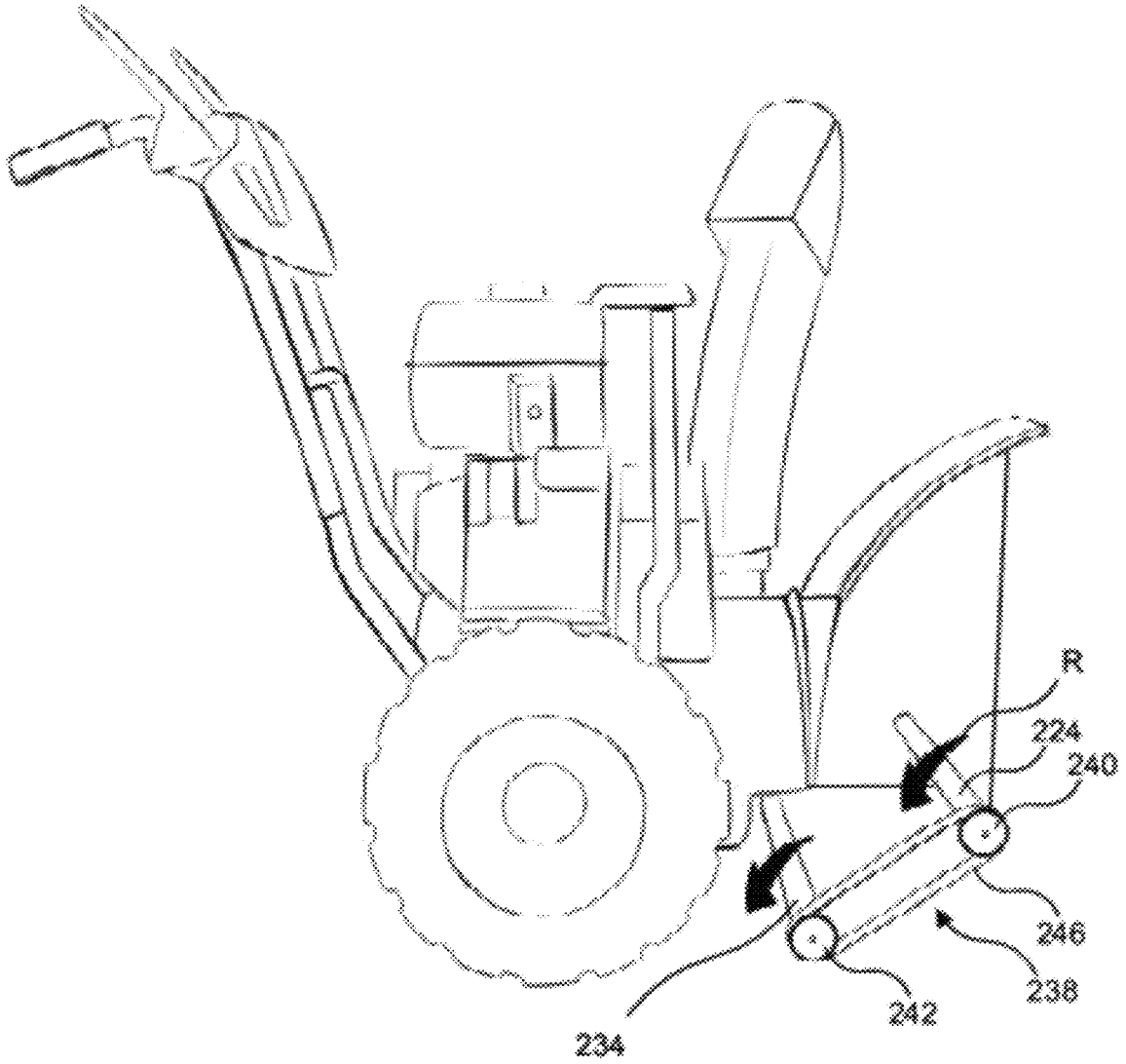
FIG. 7 depicts a side view of the example snow removal machine of FIG. 2, with a portion of the auger housing remove to expose a schematic view an example auxiliary drive assembly, according to a non-limiting embodiment.
Figure 8:
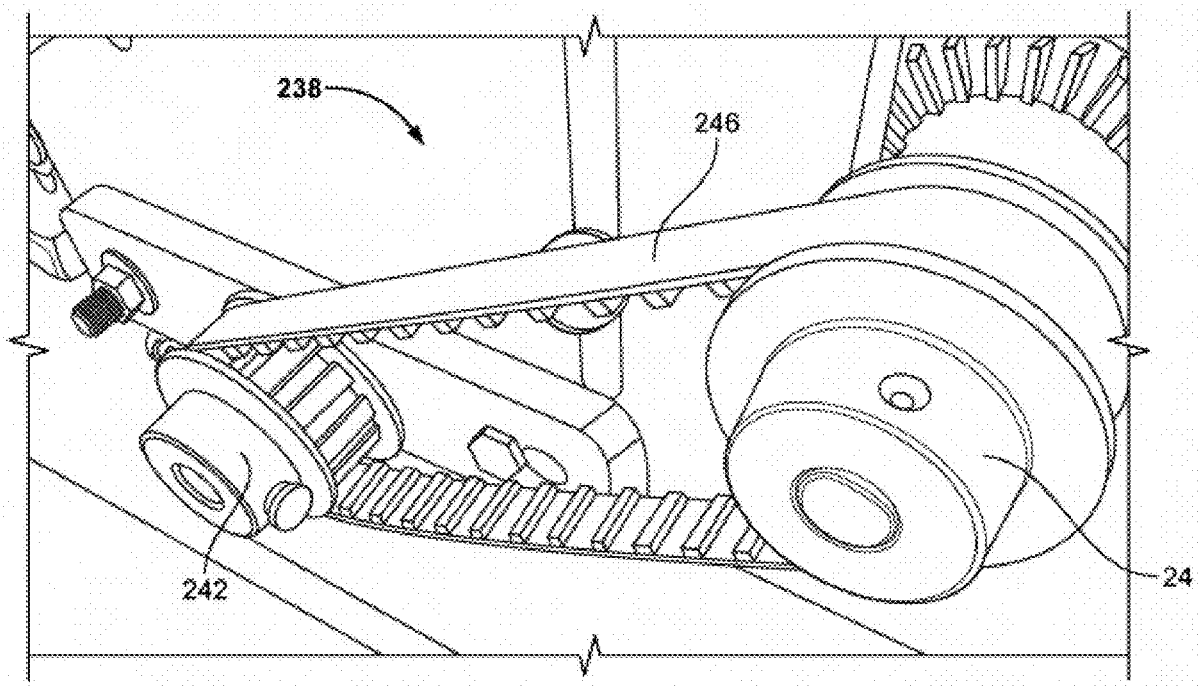
FIG. 8 depicts an enlarged view of an example auxiliary drive assembly for a snow removal machine, according to a non-limiting embodiment.
Figure 10:
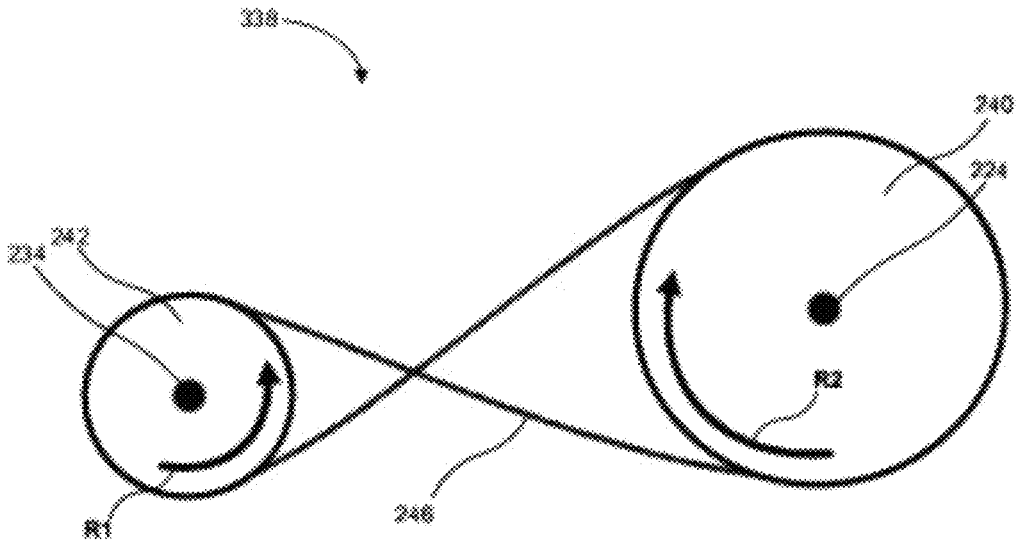
FIG. 10 depicts a schematic of another example auxiliary drive assembly for a snow removal machine, according to a non-limiting embodiment.

Any suitable configuration for the auxiliary drive assembly is contemplated. According to some embodiments, the auxiliary drive assembly, such as auxiliary drive assembly 238 depicted in FIGS. 7 and 8, is configured to drive rotation of auxiliary axle 234 in the same rotational direction as auger axle 224, R (FIG. 7). According to some embodiments, the auxiliary drive assembly is configured to drive rotation of auxiliary axle 234 in a rotational direction opposite that of auger axle 224. For example, as shown in FIG. 10, auxiliary drive assembly 338 may be configured such that auxiliary axle 234 rotates in a first rotational direction, R1, and auger axle 224 rotates in a second rotational direction, R2, opposite that of R1. The first rotational direction, R1, is such that at least some of the snow picked up by the auxiliary snow moving member(s) is directed rearwards for receipt by the discharge chute 216.

For example, according to some embodiments, auxiliary drive assembly 238, 338 comprises a belt drive assembly having at least one auger pulley 240 coupled to auger axle 224 for rotation therewith about first axis A1, at least one auxiliary pulley 242 coupled to auxiliary axle 234 for rotation therewith about second axis A2 and at least one endless drive member 246 coupled to auger pulley(s) 240 and auxiliary pulley(s) 242 for transferring torque from auger axle 224 to auxiliary axle 234. As shown in FIGS. 7 and 8, auxiliary drive assembly 238 may comprise an open belt drive assembly. As shown in FIG. 10, auxiliary drive assembly 338 may comprise a crossed belt drive assembly.

According to some embodiments, the auxiliary drive assembly, such as auxiliary drive assembly 238 and/or auxiliary drive assembly 338, is further configured to disengage and/or engage rotation of the auxiliary axle 234 from that of the auger axle 224. For example, according to some embodiments, the auxiliary drive assembly comprises a clutch mechanism, such as exemplary clutch mechanism 456 of auxiliary drive assembly 438 shown in FIGS. 12A and 12B. Clutch mechanism 456 comprises tensioner pulley 460, rotatably supported on axle 464, and idler pulley 458, rotatably supported on axle 462. Auger pulley 240 and idler pulley 458 are engaged with endless drive member 246 such that rotation of auger pulley 240 drives rotation of idler pulley 458. The rotational directions of auger pulley 240 and idler pulley 458 are shown in the example embodiment as D1.

Figure 12A:
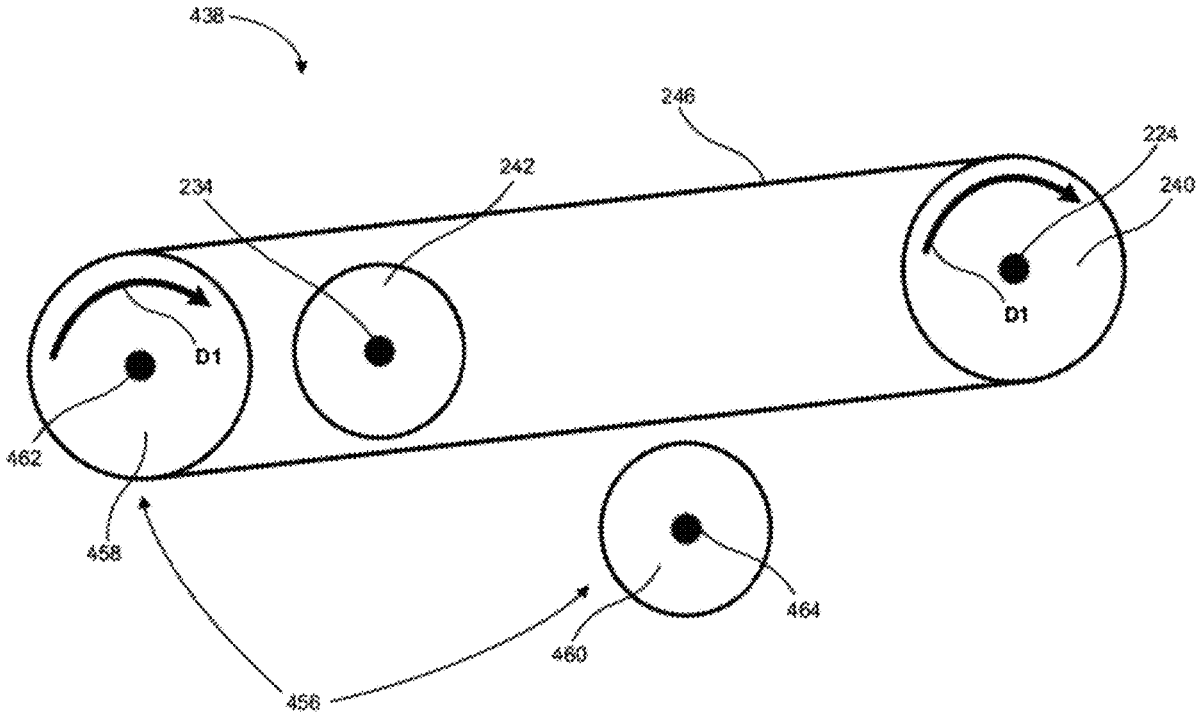
FIGS. 12A and 12B depict a schematic of another example auxiliary drive assembly for a snow removal machine having a clutch mechanism, according to another non-limiting embodiment.
Figure 12B:
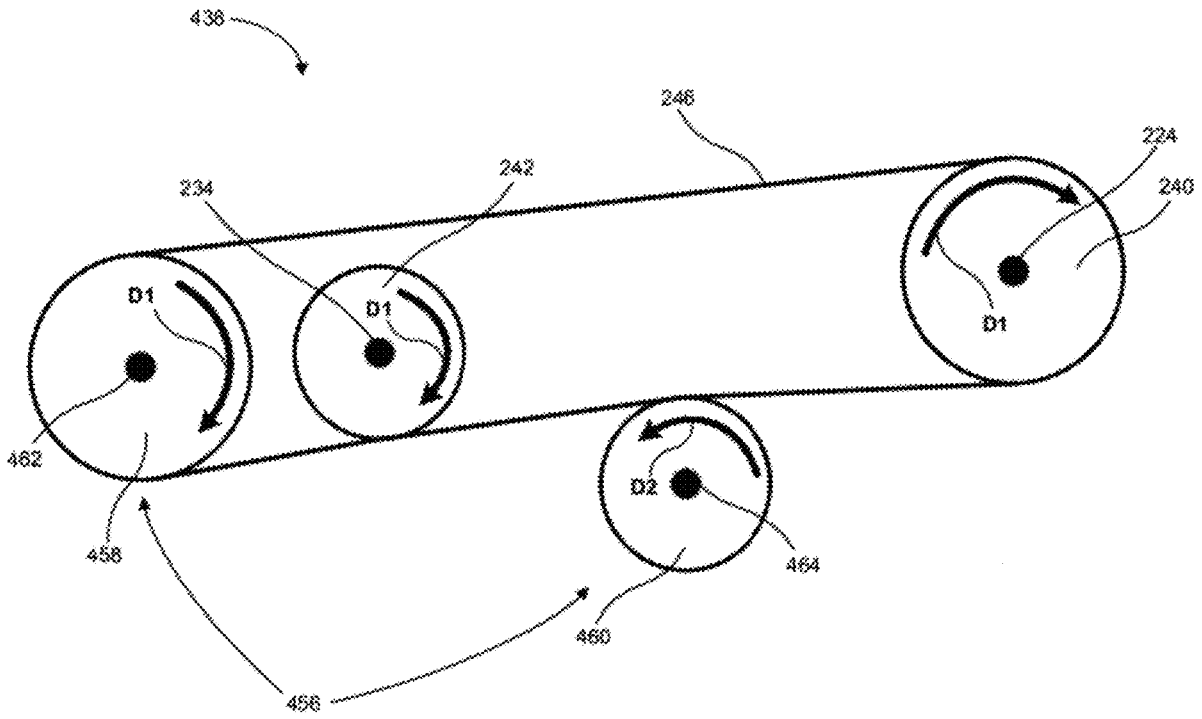
Figure 13:
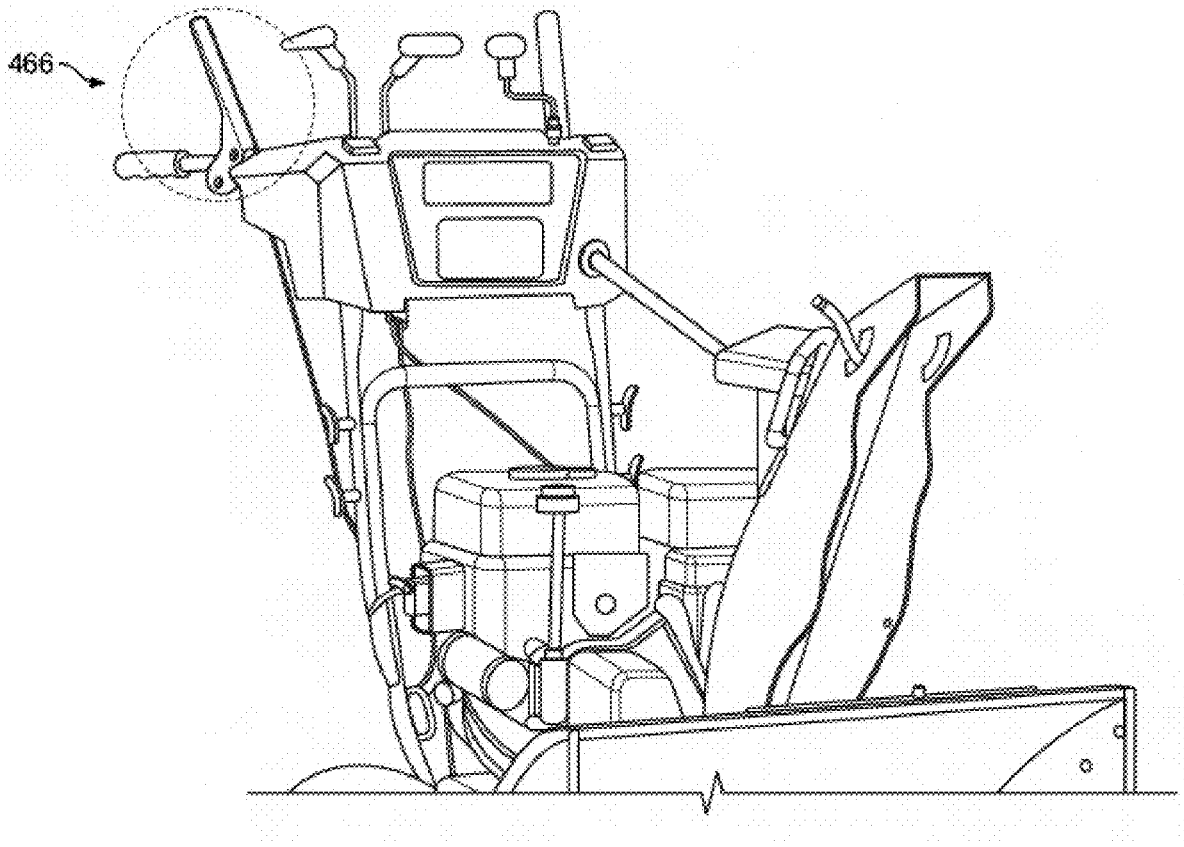
FIG. 13 depicts an enlarged view of an example lever for actuating the clutch mechanism depicted in FIGS. 12A and 12B, according to a non-limiting embodiment.

Tensioner pulley 460 is movable from a disengaged position (i.e., out of engagement with endless drive member 246), shown in FIG. 12A, to an engaged position (i.e., in driven engagement with endless drive member 246), shown in FIG. 12B, and vice-versa. When in the engaged position, the tensioner pulley 460 moves the endless drive member 246 into driven engagement with auxiliary pulley 242. As auger pulley 240 rotates, tensioner pulley 464 and auxiliary pulley 242 are also compelled to rotate by movement of endless drive member 246 (the rotational directions of auger pulley 240, idler pulley 458 and auxiliary pulley 242 are shown in the example embodiment as D1 and the rotational direction of tensioner 460 is shown in the example embodiment as D2). As discussed above, idler pulley 458 is configured to rotate with auger pulley 240. In particular, idler pulley 458 is positioned and sized such that engagement with endless drive member 246 is maintained whether tensioner pulley 460 is in the disengaged position or the engaged position (such that auxiliary pulley 242 is only engaged with endless drive member 246 when tensioner pulley 460 is in the engaged position). Tensioner pulley 460, auxiliary pulley 242 and auger pulley 240 are also sized and positioned accordingly.

According to some embodiments, tensioner pulley 460 comprises a tension adjustment mechanism (not shown) that is configured to move the tensioner pulley 460 between the disengaged and engaged position. According to some embodiments, the tension adjustment mechanism is actuatable by a lever 466 operatively connected to the tensioner adjustment mechanism. Lever 466 is situated on a control panel of the snow removal machine; however, any suitable placement of lever 466 is contemplated.

Figure 9:
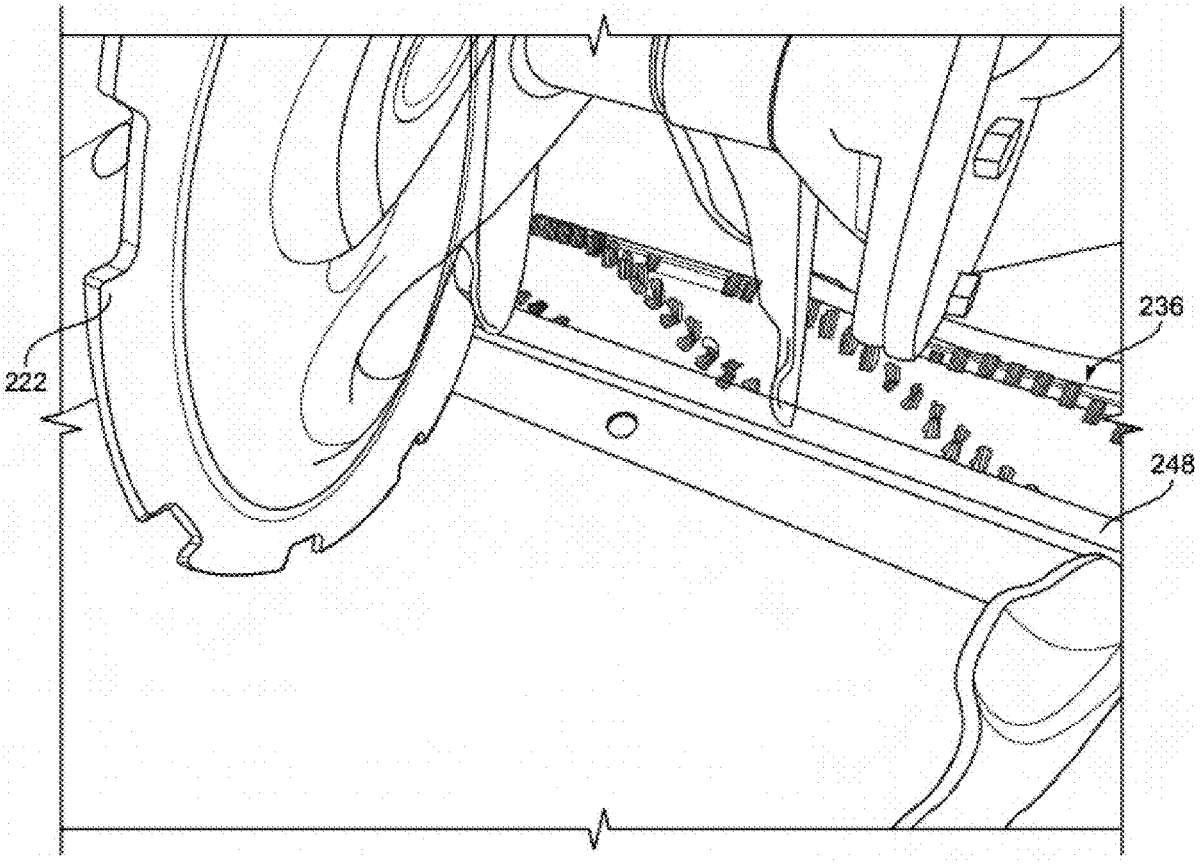
FIG. 9 depicts an enlarged view of an example assembly of a scraper bar, auxiliary snow moving assembly and auger assembly, according to a non-limiting embodiment.

According to some embodiments, example snow machine 200 includes a snow scraping blade 248 (FIG. 9). According to some embodiments, snow scraping blade 248 is coupled to the auger housing system 214 such that it is positioned rearwards of the auger blade(s) 222 and forwards of the snow moving member(s) 232. For example, according to some embodiments, snow scraping blade 248 is positioned between the auger axle 224 and the auxiliary axle 234 proximate the surface from which at least some snow is to be removed.

Persons skilled in the art will appreciate that there are yet more alternative implementations and modifications possible, and that the above examples are only illustrations of one or more implementations. The scope, therefore, is only to be limited by the claims appended hereto.

INTERPRETATION

It will also be understood that for the purposes of this application, "at least one of X, Y, and Z" or "one or more of X, Y, and Z" language can be construed as X only, Y only, Z only, or any combination of two or more items X, Y, and Z (e.g., XYZ, XYY, YZ, ZZ).

In the present application, components may be described as being "configured to" or "enabled to" perform one or more functions. Generally, it is understood that a component that is configured to or enabled to perform a function is configured to or enabled to perform the function, or is suitable for performing the function, or is adapted to perform the function, or is operable to perform the function, or is otherwise capable of performing the function.

Additionally, components in the present application may be described as being "operatively connected to", "operatively coupled to", and the like, to other components. It is understood that such components are connected or coupled to each other in a manner to perform a certain function. It is also understood that "connections", "coupling" and the like, as recited in the present application include direct and indirect connections between components.

References in the application to "one embodiment", "an embodiment", "an implementation", "a variant", etc., indicate that the embodiment, implementation or variant described may include a particular aspect, feature, structure, or characteristic, but not every embodiment, implementation or variant necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely", "only", and the like, in connection with the recitation of claim elements or use of a "negative" limitation. The terms "preferably", "preferred", "prefer", "optionally", "may", and similar terms are used to indicate that an item, condition or step being referred to is an optional (not required) feature of the invention.

The singular forms "a", "an", and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

What is claimed is:

1. A snow removal machine comprising:

an auger assembly for directing snow rearwards to be received by a discharge chute, the auger assembly having at least one auger blade coupled to an auger axle for rotation therewith about a first axis defined by the auger axle;

an auxiliary snow moving assembly for directing snow rearwards to be received by the discharge chute, the auxiliary snow moving assembly having at least one snow moving member coupled to an auxiliary axle for rotation therewith about a second axis defined by the auxiliary axle, wherein the auxiliary axle is lower and rearwards of the auger axle towards the discharge chute; and an auxiliary drive assembly configured to: rotationally couple the auxiliary axle to the auger axle such that rotation of the auxiliary axle is driven by rotation of the auger axle and disengage rotation of the auxiliary axle from that of the auger axle.

2. The snow removal machine of claim 1, wherein the snow removal machine is a snow thrower or a snow blower.

3. The snow removal machine of claim 1, wherein the auxiliary drive assembly is configured to drive rotation of the auxiliary axle in a rotational direction opposite that of the auger axle.

4. The snow removal machine of claim 1, wherein:

the at least one snow moving member comprises a brush having bristles coupled to the auxiliary axle.

5. The snow removal machine of claim 4, wherein the bristles are mounted about the auxiliary axle in a spiral pattern.

6. The snow removal machine of claim 4, wherein the bristles comprise plastic bristles each having a steel core.

7. The snow removal machine of claim 4, wherein the bristles have a length of about 0.5 inches to about 1.5 inches.

8. The snow removal machine of claim 1, wherein the auxiliary drive assembly comprises a clutch mechanism.

9. The snow removal machine of claim 1, wherein the auxiliary drive assembly comprises:

an auger pulley coupled to the auger axle for rotation therewith about the first axis;

an auxiliary pulley coupled to the at least one auxiliary axle for rotation therewith about the second axis; and an endless drive member coupled to the auger pulley and the auxiliary pulley for transferring torque from the auger axle to the auxiliary axle.

10. The snow removal machine of claim 3, wherein the auxiliary drive assembly comprises:

an auger pulley coupled to the auger axle for rotation therewith about the first axis;

an auxiliary pulley coupled to the at least one auxiliary axle for rotation therewith about the second axis; and an endless drive member coupled to the auger pulley and the auxiliary pulley for transferring torque from the auger axle to the auxiliary axle.

11. The snow removal machine of claim 1 further comprising:

a snow scraping blade positioned between the auger axle and the auxiliary axle.

12. The snow removal machine of claim 5, wherein the bristles comprise plastic bristles each having a steel core.

13. The snow removal machine of claim 5, wherein the bristles have a length of about 0.5 inches to about 1.5 inches.

14. The snow removal machine of claim 6, wherein the bristles have a length of about 0.5 inches to about 1.5 inches.

15. The snow removal machine of claim 4, wherein the auxiliary drive assembly comprises:

an auger pulley coupled to the auger axle for rotation therewith about the first axis;

an auxiliary pulley coupled to the at least one auxiliary axle for rotation therewith about the second axis; and an endless drive member coupled to the auger pulley and the auxiliary pulley for transferring torque from the auger axle to the auxiliary axle.

16. The snow removal machine of claim 8, wherein the auxiliary drive assembly comprises:

an auger pulley coupled to the auger axle for rotation therewith about the first axis;

an auxiliary pulley coupled to the at least one auxiliary axle for rotation therewith about the second axis; and an endless drive member coupled to the auger pulley and the auxiliary pulley for transferring torque from the auger axle to the auxiliary axle.

17. An auxiliary snow moving assembly for a snow removal machine comprising:

an auxiliary axle defining a rotational axis;

a snow moving member for directing snow rearwards to be received by a discharge chute of the snow removal machine, the snow moving member being coupled to the auxiliary axle for rotation therewith about the rotational axis;

an attachment assembly for coupling the auxiliary axle to the snow removal machine and for positioning the auxiliary axle rearwards and lower than an auger axle having at least one auger blade mounted for rotation therewith; and an auxiliary drive assembly for coupling the auxiliary axle to the auger axle such that rotation of the auxiliary axle is driven by rotation of the auger axle, wherein the auxiliary drive assembly is configured to disengage rotation of the auxiliary axle from that of the auger axle.

18. The auxiliary snow moving assembly of claim 17, wherein the auxiliary drive assembly comprises a clutch mechanism.

* * * * *